US012305510B2

(12) United States Patent
Larsen

(10) Patent No.: US 12,305,510 B2
(45) Date of Patent: May 20, 2025

(54) RECEIVER HITCH-MOUNTED ICE DRILL DEVICE

(71) Applicant: Matt Larsen, Wyoming, MN (US)

(72) Inventor: Matt Larsen, Wyoming, MN (US)

( * ) Notice: Subject to any disclaimer, the term of this patent is extended or adjusted under 35 U.S.C. 154(b) by 0 days.

(21) Appl. No.: 18/186,271

(22) Filed: Mar. 20, 2023

(65) Prior Publication Data

US 2023/0313614 A1 Oct. 5, 2023

Related U.S. Application Data

(60) Provisional application No. 63/324,790, filed on Mar. 29, 2022.

(51) Int. Cl.

| | |
|---|---|
| ***E21B 7/02*** | (2006.01) |
| ***E21B 3/02*** | (2006.01) |
| ***E21B 7/00*** | (2006.01) |

(52) U.S. Cl.
CPC ..... *E21B 7/027* (2013.01); *E21B 3/02* (2013.01); *E21B 7/008* (2013.01)

(58) Field of Classification Search
CPC ..... E21B 3/02; E21B 7/027; E21B 7/008
See application file for complete search history.

(56) References Cited

U.S. PATENT DOCUMENTS

| | | | | |
|---|---|---|---|---|
| 2,692,757 | A | 10/1954 | Folstad | |
| 3,132,705 | A | 5/1964 | McGee | |
| 3,602,321 | A | 8/1971 | Kortschaga | |
| 3,907,043 | A * | 9/1975 | Appleman | E21B 7/046 173/218 |
| 6,681,470 | B1 | 1/2004 | Scott | |
| 8,397,835 | B1 | 3/2013 | Lyngaas | |
| 2002/0014352 | A1* | 2/2002 | Rust | E21B 7/024 175/203 |
| 2004/0195285 | A1* | 10/2004 | Pinard | B60R 11/06 224/510 |
| 2010/0224746 | A1 | 9/2010 | Johnson | |
| 2013/0233625 | A1* | 9/2013 | Robinson | E21B 7/027 175/203 |
| 2016/0305187 | A1* | 10/2016 | Dorsch | E21B 7/021 |
| 2018/0236949 | A1* | 8/2018 | Whitehurst | B66F 3/44 |

* cited by examiner

*Primary Examiner* — Nicole Coy
*Assistant Examiner* — Jennifer A Railey
(74) *Attorney, Agent, or Firm* — Brennan, Manna & Diamond, LLC

(57) ABSTRACT

The present invention relates to a receiver hitch-mounted ice drill device for ice fishing. The device allows a user to move an ice drill while attached to a vehicle while the drill remains outside of the vehicle. In addition, the device allows a user to remotely operate an ice drill of the device from within a vehicle.

2 Claims, 2 Drawing Sheets

RECEIVER HITCH-MOUNTED ICE DRILL DEVICE

CROSS-REFERENCE TO RELATED APPLICATION

The present application claims priority to, and the benefit of, U.S. Provisional Application No. 63/324,790, which was filed on Mar. 29, 2022, and is incorporated herein by reference in its entirety.

FIELD OF THE INVENTION

The present invention relates generally to the field of ice drills. More specifically, the present invention relates to a receiver hitch-mounted ice drill device that allows a user to move an ice drill while attached to a vehicle while the ice drill is positioned outside of the vehicle. In addition, the device allows a user to remotely operate an ice drill of the device from within a vehicle. Accordingly, the present disclosure makes specific reference thereto. Nonetheless, it is to be appreciated that aspects of the present invention are also equally applicable to other like applications, devices, and methods of manufacture.

BACKGROUND

Ice drills are used to create holes in ice for ice fishing. However, ice drills are physically large and heavy tools. As a result, ice drills just be moved within or on an ATV, truck, or other vehicle. This process can be difficult, especially if the ice drill must be transported in the interior of the vehicle (which can result in the dirtying and/or melting of ice within the vehicle interior). Furthermore, a user must physically exit the vehicle and drill into the ice using the ice drill. This is undesirable, especially in cold climates.

Therefore, there exists a long-felt need in the art for a transportation device for ice drills. There also exists a long-felt need in the art for a device that allows a user to transport an ice drill via a vehicle, ATV, truck, etc. More specifically, there exists a long-felt need in the art for a receiver hitch-mounted ice drill device that allows a user to transport an ice drill via a vehicle, ATV, truck, etc., that does not require the ice drill to be stored on/in the vehicle. In addition, there exists a long-felt need in the art for a receiver hitch-mounted ice drill device that allows a user to operate an ice drill without exiting a vehicle.

The subject matter disclosed and claimed herein, in one embodiment thereof, comprises a receiver hitch-mounted ice drill device. The device is primarily comprised of a hitch, a motor, a drill housing with a drill bit, and a receiver. The device can be attached to a female trailer receiver of a vehicle to allow the device to be transported outside of the vehicle. The drill bit of the device is preferably an ice drilling drill bit that can be raised and lowered from the drill housing via a motor. The raising and lowering of the drill bit and the power to the drill bit can be controlled from within the vehicle the device is attached to via a remote which is in wireless electrical communication with the motor.

In this manner, the receiver hitch-mounted ice drill device of the present invention accomplishes all the foregoing objectives and provides a device for moving an ice drill. More specifically, the device allows a user to transport an ice drill via a vehicle, ATV, truck, etc., that does not require the ice drill to be stored on/in the vehicle. In addition, the device allows a user to operate an ice drill without exiting a vehicle.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a receiver hitch-mounted ice drill device primarily comprised of a hitch, a motor, a drill housing with a drill bit, and a receiver. The device allows a user to drill an ice hole for ice fishing without having to exit a vehicle and also allows a user to transport an ice drill via the outside of said vehicle.

The device attaches to a female hitch receiver of a vehicle via at least one male hitch that can be inserted into the female hitch receiver and may be any type of male hitch known in the art. The drill housing is fixedly connected to the hitch and may have at least one chuck. At least one drill bit may be removably or fixedly attached to the chuck, wherein the bit is preferably an auger-style drill bit designed for drilling holes in the ice for ice fishing.

The drill bit moves up and down from the housing via at least one spindle powered by at least one motor. The spindle moves up and down to rotate the drill bit which allows the drill bit to be extended from the housing (to drill into ice) and be retracted into the housing when not in use and during transport. The motor may be any type of electric or gas motor known in the art.

The functions of the drill bit may be controlled via at least one remote with at least one transmitter which is in wireless electrical communication via Bluetooth, Wi-Fi, etc., with at least one receiver that is in electrical communication with the motor and/or spindle. The remote also has at least one button. The button allows a user to turn the motor on/off to raise, lower, and activate the drill bit. The motor may have a plurality of speeds that the drill bit can be rotated at. In one embodiment, the button may be located on the drill housing.

The present invention is also comprised of a method of using the device. First, a device is provided comprised of a hitch, a motor, a drill housing with a drill bit, a receiver, and a remote comprised of a transmitter. Then, the hitch of the device can be attached to the hitch receiver of a vehicle and secured within the hitch receiver via a fastener. Then, the drill bit can be powered on and lowered from the drill housing with at least one remote from within the vehicle to drill a hole into the ice. Once the hole has been drilled, the bit can be retracted into the housing via the remote.

Accordingly, the receiver hitch-mounted ice drill device of the present invention is particularly advantageous as it provides a device for moving an ice drill. More specifically, the device allows a user to transport an ice drill via a vehicle, ATV, truck, etc., that does not require the ice drill to be stored on/in the vehicle. In addition, the device allows a user to operate an ice drill without exiting a vehicle. In this manner, the receiver hitch-mounted ice drill device provides a solution to moving an ice drill outside of a vehicle.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
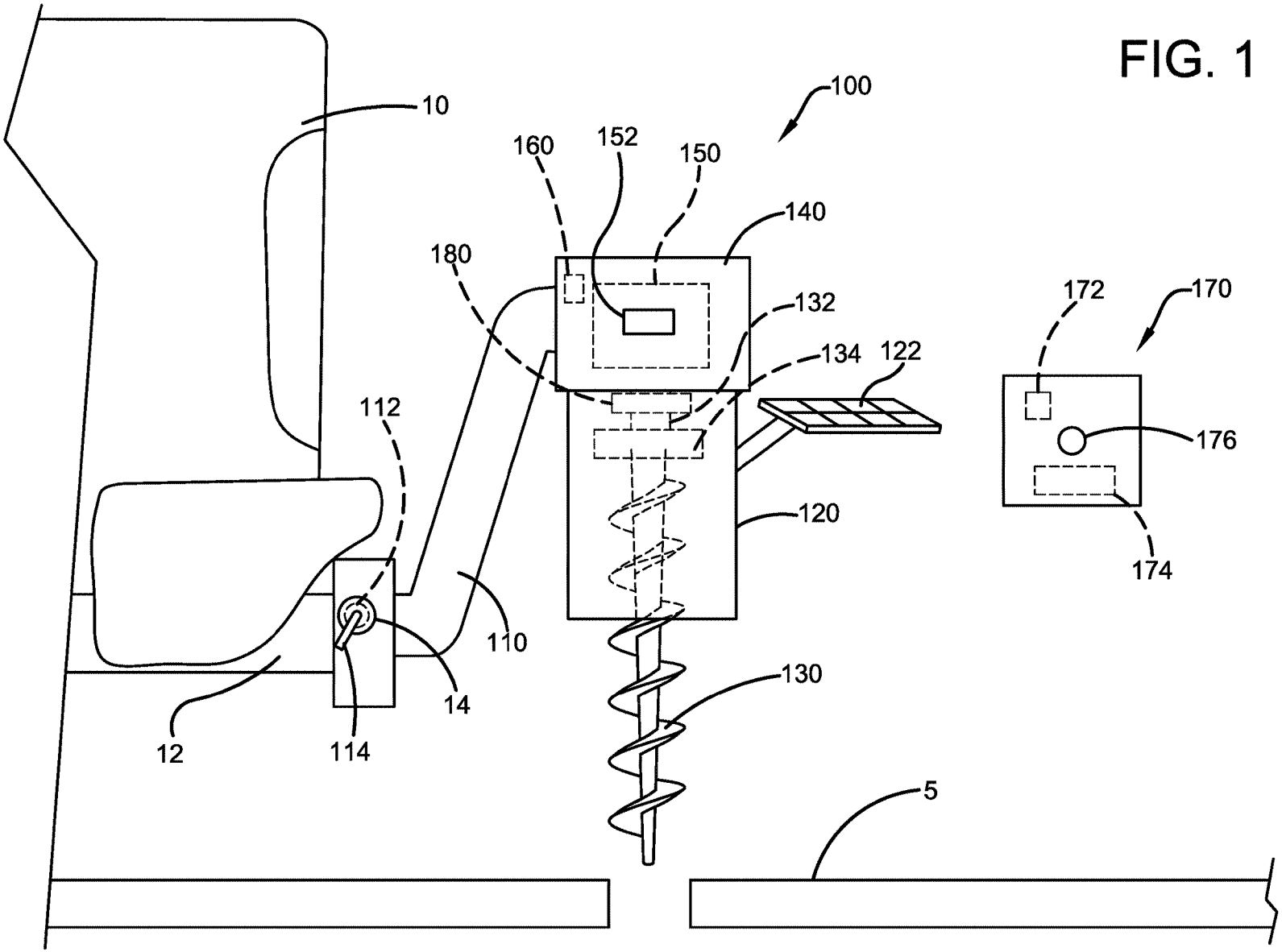
FIG. 1 illustrates a side view of one potential embodiment of a receiver hitch-mounted ice drill device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a transportation device for ice drills. There also exists a long-felt need in the art for a device that allows a user to transport an ice drill via a vehicle, ATV, truck, etc. More specifically, there exists a long-felt need in the art for a receiver hitch-mounted ice drill device that allows a user to transport an ice drill via a vehicle, ATV, truck, etc., that does not require the ice drill to be stored on/in the vehicle. In addition, there exists a long-felt need in the art for a receiver hitch-mounted ice drill device that allows a user to operate an ice drill without exiting a vehicle.

The present invention, in one exemplary embodiment, is comprised of a receiver hitch-mounted ice drill device a receiver hitch-mounted ice drill device primarily comprised of a hitch, a motor, a drill housing with a drill bit, and a receiver. The device allows a user to drill an ice hole for ice fishing without having to exit a vehicle and also allows a user to transport an ice drill via the outside of said vehicle.

The device attaches to a female hitch receiver of a vehicle via at least one male hitch that can be inserted into the female hitch receiver and may be any type of male hitch known in the art. The drill housing is fixedly connected to the hitch and may have at least one chuck. Furthermore, at least one drill bit may be removably or fixedly attached to the chuck, wherein the bit is preferably an auger-style drill bit designed for drilling holes in the ice for ice fishing. During use, the drill bit moves up and down from the housing via at least one spindle powered by at least one motor. The spindle moves up and down to rotate the drill bit which allows the drill bit to be extended from the housing (to drill into ice) and be retracted into the housing when not in use and during transport. The motor may be any type of electric or gas motor known in the art.

The functions of the drill bit may be controlled via at least one remote with at least one transmitter in wireless electrical communication via Bluetooth, Wi-Fi, etc., with at least one receiver that is in electrical communication with the motor and/or spindle. The remote also has at least one button. The button allows a user to turn the motor on/off to raise, lower, and activate the drill bit. The motor may have a plurality of speeds that the drill bit can be rotated at. In one embodiment, the button may be located on the drill housing.

The present invention is also comprised of a method of using the device. First, a device is provided comprised of a hitch, a motor, a drill housing with a drill bit, a receiver, and a remote comprised of a transmitter. Then, the hitch of the device can be attached to the hitch receiver of a vehicle and secured within the hitch receiver via a fastener. Then, the drill bit can be powered on and lowered from the drill housing with at least one remote from within the vehicle to drill a hole into the ice. Once the hole has been drilled, the bit can be retracted into the housing via the remote.

Accordingly, the receiver hitch-mounted ice drill device of the present invention is particularly advantageous as it provides a device for moving an ice drill. More specifically, the device allows a user to transport an ice drill via a vehicle, ATV, truck, etc., that does not require the ice drill to be stored on/in the vehicle. In addition, the device allows a user to operate an ice drill without exiting a vehicle. In this manner, the receiver hitch-mounted ice drill device provides a solution to moving an ice drill outside of a vehicle.

Referring initially to the drawings, FIG. 1 illustrates a side view of one potential embodiment of a receiver hitch-mounted ice drill device 100 of the present invention in accordance with the disclosed architecture. The device 100 is primarily comprised of a hitch 110, a motor 140, a drill housing 120 with a drill bit 130, and a receiver 160. All components of the device 100 are preferably comprised of a corrosion-resistant metal material such as, but not limited to, stainless steel, or a rigid plastic material. The device 100 allows a user to drill an ice hole for ice fishing without having to exit a vehicle 10, and also allows a user to transport an ice drill via the outside of said vehicle 10.

The device 100 attaches to a female hitch receiver 12 of a vehicle 10 via at least one male hitch 110. The hitch 110 is inserted into the female hitch receiver 12 and may be any type of male hitch known in the art. The hitch 110 can be secured within the hitch receiver 12 via at least one fastener 114 such as, but not limited to, a hitch pin or other similar fastener of the like. The fastener 114 can be placed through at least one opening 112 of the hitch 110 and an opening 14 of the hitch receiver 12. In one embodiment, the hitch 110 is comprised of a ball-screw assembly. In one embodiment, the hitch 110 may also be height adjustable.

The drill housing 120 is fixedly connected to the hitch 110. The housing 120 houses at least one chuck 134 of any type of drill chuck known in the art. At least one drill bit 130 may be removably or fixedly attached to the chuck 134. The drill bit 130 may be any type known in the art. However, the bit 130 is preferably an auger-style drill bit designed for drilling holes in the ice for ice fishing. The bit 130 may be any diameter known in the art. The bit 130 may also be any length to account for any depth of ice 5.

The drill bit 130 moves up and down from the housing 120 via at least one spindle 132 powered by at least one motor 140. The spindle moves up and down to rotate the drill bit 130. This allows the drill bit 130 to be extended from the housing (to drill into ice 5) and be retracted into the housing 120 when not in use and during transport. The motor 140 may be any type of electric motor known in the art. In another embodiment, the drill bit 130 may be directly attached to the motor 140, wherein the motor 140 rotates the bit 130. In another embodiment, the motor 140 may be any gas or diesel motor known in the art.

The motor 140 is powered by at least one battery 150 stored within the housing 120. In one embodiment, the battery 150 can be charged via at least one charging port 152. The port 152 may be any type of battery charging port known in the art. In one embodiment, the battery 150 can be recharged via at least one solar panel 122 positioned on the exterior of the housing 120. The solar panel 122 may be any type known in the art such as, but not limited to, monocrystalline, polycrystalline, thin film, etc. In another embodiment, the device 100 is comprised of a second motor 140 that powers at least one actuator 180. The actuator 180 moves the bit 130 up and down within/from the housing 120.

The functions of the drill bit 130 may be controlled via at least one remote 170. The remote 170 is comprised of at least one transmitter 172 which is in wireless electrical communication via Bluetooth, Wi-Fi, etc., with at least one receiver 160 that is in electrical communication with the motor 140 and/or spindle 132. The remote 170 is powered by at least one battery 174.

The remote 170 also has at least one button 176. The button 176 allows a user to turn the motor 140 on/off to raise, lower, and activate the drill bit 130. The motor 140 may have a plurality of speeds that the drill bit 130 can be rotated at. In one embodiment, the button 176 may be located on the drill housing 120.

Figure 2:
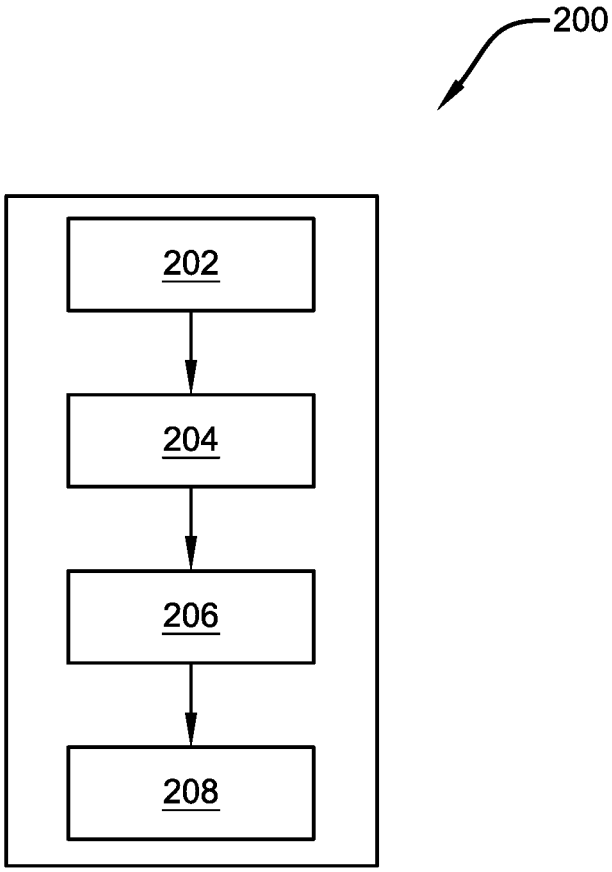
FIG. 2 illustrates a flowchart of a method of using one potential embodiment of a receiver hitch-mounted ice drill device of the present invention in accordance with the disclosed architecture.

The present invention is also comprised of a method of using the device 100, as seen in FIG. 2. First, a device 100 is provided and is comprised of a hitch 110, a motor 140, a drill housing 120 with a drill bit 130, a receiver 160, and a remote 170 comprised of a transmitter 172 [Step 202]. Then, the hitch 110 of the device 100 can be attached to the hitch receiver 12 of a vehicle 10 and secured within the hitch receiver 12 via a fastener 114 that can be placed through an opening 112 in the hitch 110 and an opening 14 of the receiver 12 [Step 204]. Then, the drill bit 130 can be powered on and lowered from the drill housing 120 with at least one remote 170 from within the vehicle 10 to drill a hole into ice 5 [Step 206]. Once the hole has been drilled, the bit 130 can be retracted into the housing 120 via the remote 170 [Step 208].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "receiver hitch-mounted ice drill device" and "device" are interchangeable and refer to the receiver hitch-mounted ice drill device 100 of the present invention.

Notwithstanding the foregoing, the receiver hitch-mounted ice drill device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the receiver hitch-mounted ice drill device 100 as shown in the FIGS. are for illustrative purposes only, and that many other sizes and shapes of the receiver hitch-mounted ice drill device 100 are well within the scope of the present disclosure. Although the dimensions of the receiver hitch-mounted ice drill device 100 are important design parameters for user convenience, the receiver hitch-mounted ice drill device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method of using a receiver hitch-mounted ice drill device, the method comprising the steps of:
   - providing a receiver hitch-mounted ice drill device comprised of a hitch, a motor, a drill housing with a drill bit, and a remote comprised of a transmitter;
   - attaching the hitch to a hitch receiver of a vehicle;
   - adjusting a height of the hitch;
   - securing the hitch into the hitch receiver via a fastener;
   - activating the motor via the remote;
   - extending the drill bit from the drill housing via the remote;
   - activating the drill bit via the remote;
   - drilling a hole in an ice surface;
   - deactivating the drill bit via the remote;
   - retracting the drill bit into the drill housing via the remote; and
   - deactivating the motor via the remote; and
   - wherein the drill bit is adapted to extend and retract via a spindle powered by the motor.

2. The method of claim 1, wherein the drill bit is comprised of an ice auger drill bit.

* * * * *